US007490901B2

(12) United States Patent
Maier et al.

(10) Patent No.: US 7,490,901 B2
(45) Date of Patent: Feb. 17, 2009

(54) BACK REST FOR A CHAIR

(75) Inventors: Peter Maier, Herrischried (DE); Harry Fischer, Wutöschingen (DE)

(73) Assignee: Sedus Stoll Aktiengesellschaft, Waldshut (DE)

( * ) Notice: Subject to any disclaimer, the term of this patent is extended or adjusted under 35 U.S.C. 154(b) by 0 days.

(21) Appl. No.: 11/975,172

(22) Filed: Oct. 18, 2007

(65) Prior Publication Data

US 2008/0093905 A1 Apr. 24, 2008

(30) Foreign Application Priority Data

Oct. 18, 2006 (DE) ..... 10 2006 049 677

(51) Int. Cl.
*A47C 3/00* (2006.01)

(52) U.S. Cl. ..... 297/291

(58) Field of Classification Search ..... 297/353, 297/354.1, 284.11, 291, 301.1; 403/68, 66
See application file for complete search history.

(56) References Cited

U.S. PATENT DOCUMENTS 2,579,918 A * 12/1951 Freeman ..... 297/291
2,796,920 A * 6/1957 Cowles ..... 297/291
3,934,930 A * 1/1976 Sandham ..... 297/291
4,400,032 A * 8/1983 dePolo ..... 297/344.24
6,116,687 A * 9/2000 Vogtherr ..... 297/300.1

FOREIGN PATENT DOCUMENTS

| | | |
|---|---|---|
| CH | 275 739 | 9/1951 |
| DE | 921588 | 12/1954 |
| EP | 0935934 | 8/1999 |
| EP | 1 192 882 | 9/2001 |

* cited by examiner

*Primary Examiner*—Milton Nelson, Jr.
(74) *Attorney, Agent, or Firm*—D. Peter Hochberg; Sean F. Mellino; Daniel J. Smola

(57) ABSTRACT

A back rest for a chair with a back support and a back surface secured to the back support and able to swivel about a two-axis joint. The joint has a joint plate connected to the back surface, an element made of an elastic material that supports the joint in a ground position, and a chamber to accommodate the elastic element, connected to the back support. The joint plate is arranged in the receiving chamber between two elements made from an elastic material, holding the joint in a ground position and each being supported against the receiving chamber, and it can swivel about the two swivel axes. When the joint is placed under load, the two elastic elements are only subjected to compression. There are no tension-loaded connections which break under loading and can result in the joint falling apart.

13 Claims, 2 Drawing Sheets

BACK REST FOR A CHAIR

CROSS-REFERENCE TO RELATED APPLICATIONS

This application claims foreign priority based on German Patent Application No. 10 2006 049 677.9, filed on Oct. 18, 2006, the content of which is incorporated herein by reference in its entirety.

BACKGROUND OF THE INVENTION

1. Field of the Invention

The present invention relates to a back rest for a chair with a back support and a back surface secured thereto and which is able to swivel about a two-axis joint, wherein the joint has a joint plate connected to the back surface, an element made of an elastic material that supports the joint in a ground position, and a chamber to accommodate the elastic element, connected to the back support.

2. Description of the Prior Art

A back rest of this kind is known from EP 0 935 934 A2, where the joint comprises two joint plates, also referred to as end plates. One of these end plates is connected by a screw to the back surface. The second end plate is connected by a screw to the back support. Between the two end plates is vulcanized a material layer consisting of an elastic rubber material, which allows the two end plates to move relative to each other and, thus, the joint, and supports the joint in a ground position. The second end plate, as well as the major portion of the material layer, is accommodated in a chamber provided in the back support. The drawback to this design is that the back falls away from the back support when the connection between one of the end plates and the elastic rubber element is released. If this occurs when a person is leaning against the back rest, the person can fall backward resulting in serious injuries.

SUMMARY OF THE PRESENT INVENTION

The problem of the present invention is to specify a back rest of the kind mentioned above, in which no such detachment can occur.

This problem is solved in accordance with the present invention. Advantageous embodiments and further modifications of the invention are discussed herein.

The back rest of the present invention is accordingly comprises a joint plate that is arranged in the receiving chamber between two elements made from an elastic material, holding the joint in a ground position and each being supported against the receiving chamber, and it can swivel about the two swivel axes.

The invention avoids the breakaway problem since it does not use connections in the joint like those of the prior art. The elastic elements used according to the invention are loaded only by compression and not by tension when the back surface swivels relative to the back support in the receiving chamber. Therefore, it does not require any firm connection at the boundary surfaces between the joint plate and the two elastic elements. As is also provided in a preferred embodiment, the two elastic elements can be loosely accommodated in the receiving chamber and also do not need to have any firm connection to the joint plate. In particular, no vulcanized connection is needed, so that a different material, not elastic rubber, can also be used for the elastic elements.

A simple configuration of the joint results when at least one of the two elastic elements is ring-shaped and the back surface is joined to the joint plate through this ring-shaped elastic element.

For the two elastic elements, a compressible foam material is preferably used, especially an open-pore PUR foam material. In this case, the elastic elements can be dimensioned such that they, along with the joint plate, entirely fill up the inner space of the receiving chamber and therefore the joint is free of play. The two elastic elements are even preferably precompressed in the receiving chamber so as to achieve greater stiffness of the joint. This also produces an advantageously small volume for the receiving chamber, so that the joint as a whole can be very compact in construction. This would not be possible with an elastic rubber material, as used in the prior art, because although an elastic rubber material is elastically deformable, it is hardly compressible at all, and therefore free space would have to be provided in the receiving chamber.

The receiving chamber is advantageously assembled from two parts screwed together, in particular, a pot-shaped part and a plate-shaped part, while one of the parts, such as the pot-shaped part, can be directly molded or fashioned on the back support.

A turning of the back surface about an axis perpendicular to the two swivel axes can be desirable. In most cases, however, one will prefer the back surface to be oriented always the same with respect to the back support, for aesthetic reasons. This can be accomplished by securing the joint plate against twisting in the receiving chamber.

BRIEF DESCRIPTION OF THE FIGURES

The invention shall now be explained in more detail by a sample embodiment in connection with the drawings.

DETAILED DESCRIPTION OF THE PRESENT INVENTION

Figure 1:
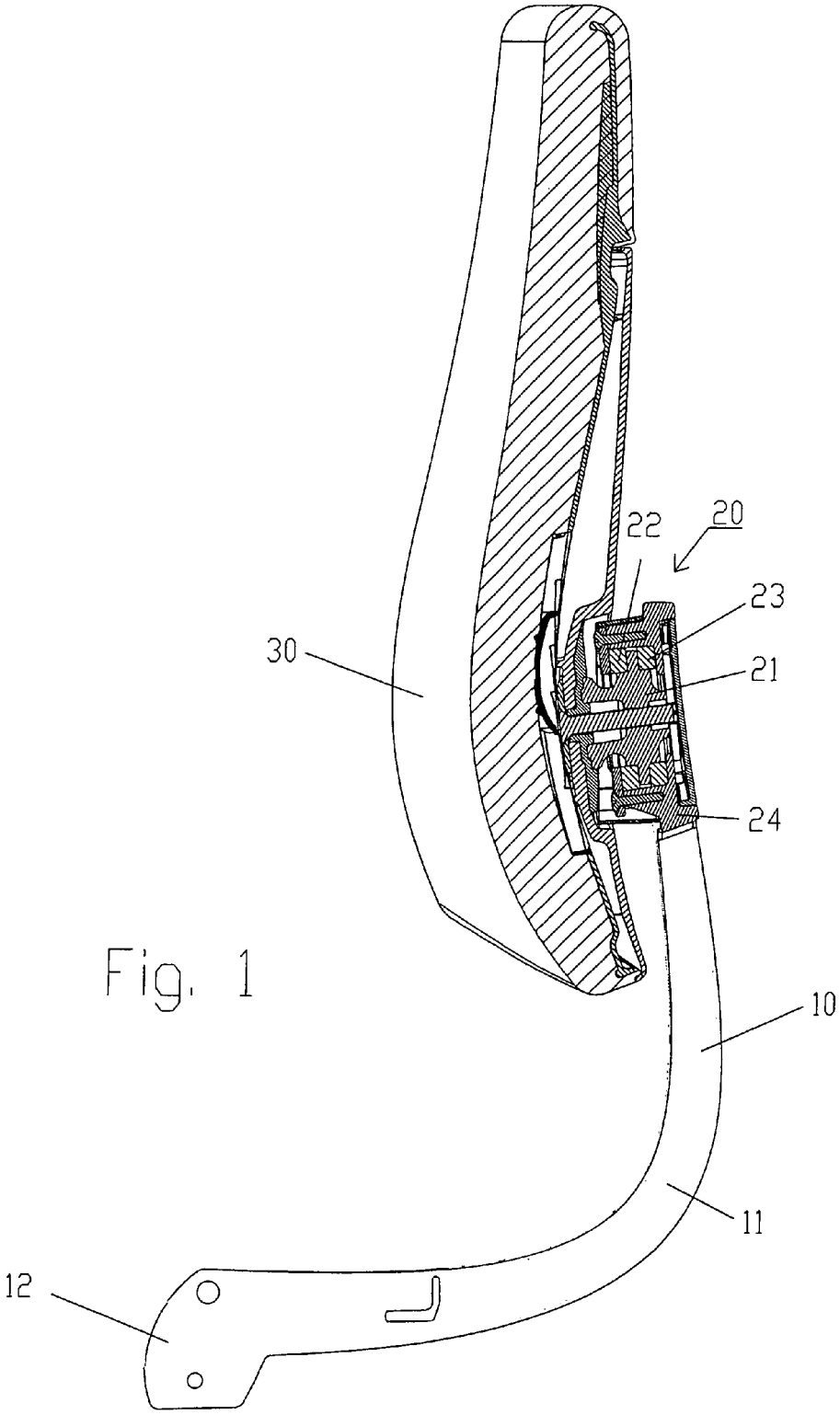
FIG. 1 is a side cross-sectional view of the back rest in accordance with the present invention in a vertical section through its midplane.
Figure 2:
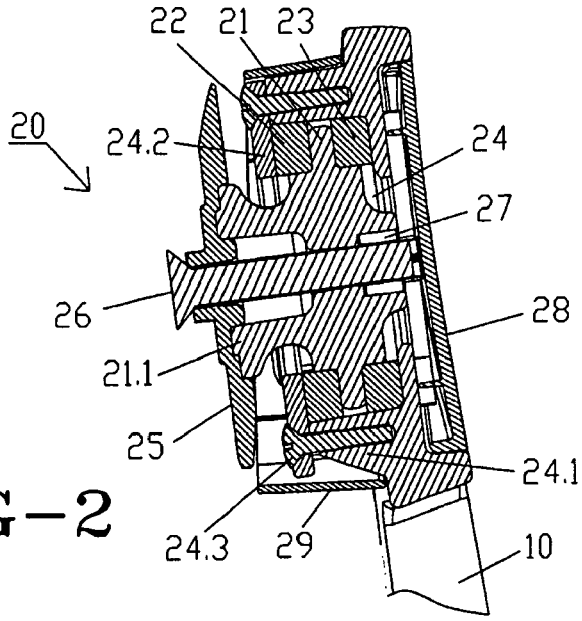
FIG. 2 is an enlarged view of the joint of the back rest of FIG. 1.

The back rest shown in the drawings is intended in particular for mounting on the lower frame (not shown) of an office chair. It comprises a back support 10, on which a back surface 30 is fastened and can swivel via a joint 20.

Figure 3:
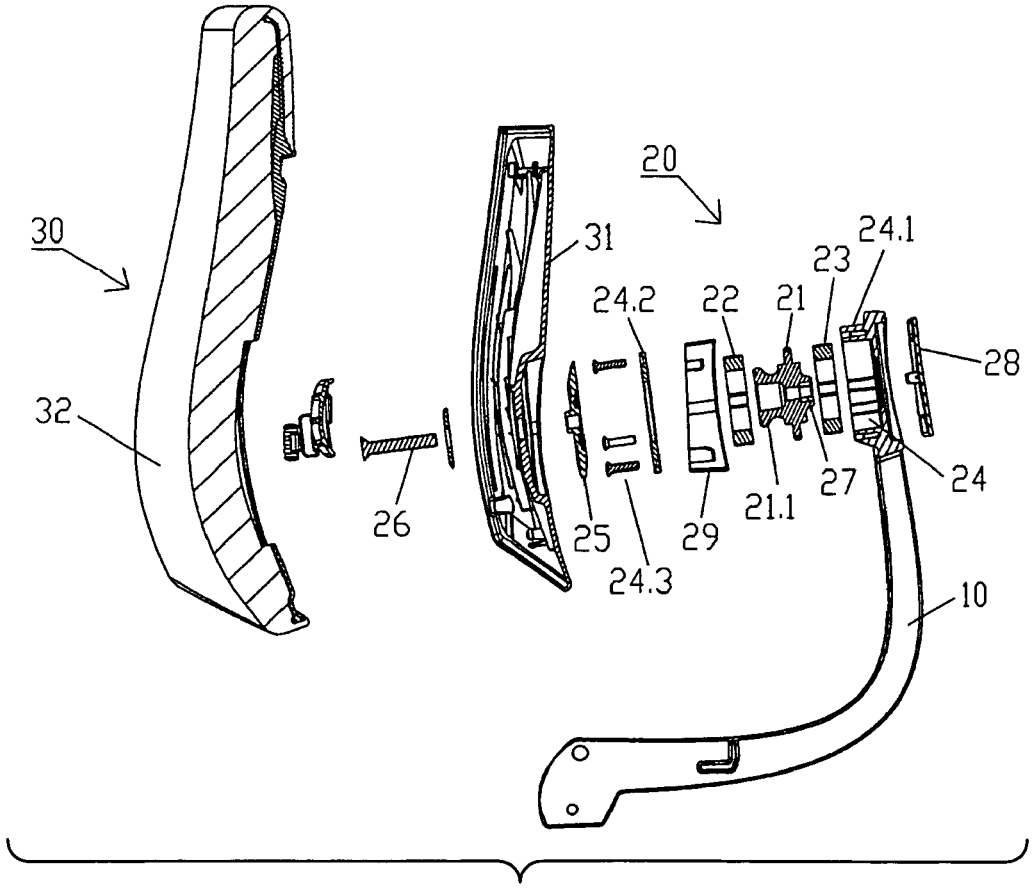
FIG. 3 is an exploded diagram of the back rest of FIG. 1.

The back support 10 is formed by two support rods 11, roughly parallel to each other, of which the rear rod 11 can be seen in FIGS. 1 and 3. The support rods 11 are joined by their lower free ends 12 to the aforesaid lower frame. In the area of their upper end, the two support rods 11 are joined to each other and also to a pot-shaped part 24.1 of a receiving chamber 24 of the joint 20, enclosing the pot-shaped part 24.1 of the receiving chamber 24 in U-shaped manner.

The joint 20 moreover includes a joint plate 21, which is embedded in the receiving chamber 24 between two ring-shaped elements 22 and 23 and is itself ring-shaped, due to a central continuous hole. The ring-shaped elements 22, 23 are made of an elastic as well as compressible material, especially a foam material, and preferably an open-pore PUR foam material. Ring-shaped elements 22, 23 are loosely accommodated in the chamber and also have no firm connection to the joint plate.

The receiving chamber 24 is two part and consists of the aforementioned pot-shaped part 24.1 and a ring plate 24.2. The ring plate 24.2 can be screwed to the pot-shaped part 24.1 by screws 24.3. The overall thickness of the stack made up of the two ring-shaped elements 22 and 23 and the joint plate 21 is greater than the depth of the receiving chamber 24. Therefore, the elements 22 and 23 are compressed when the ring plate 24.2 is screwed onto the pot-shaped part 24.1.

The back surface 30 is joined by a screw 26 and a nut 27 to the joint plate 21. The screw 26 passes through a rear shell 31, supporting the cushion 32 of the back surface 30, a ring-shaped pressure distribution plate 25 that is supported against this, the ring plate 24.2, the ring-shaped element 22, the joint plate 21, and finally also the rear wall of the pot-shaped part 24.1 of the receiving chamber 24, which also has a central opening for this purpose. The nut 27 is held fast, unable to turn, in a hexagonal seat on the back side of the joint plate 21, away from the back surface 30.

The joint plate 21 penetrates the ring plate 24.2 with a molded lug 21.1, which has some play relative to the ring plate 24.2 in the penetration area and widens toward the back surface 30. The aforementioned pressure distribution plate 25 rests against this lug 21.1 at its rear side, being even larger in surface than lug 21.1, and also preferably intermeshes with lug 21.1 so that distribution plate 25 cannot turn relative to lug 21.1. Due to the lug 21.1 and the mentioned seat for the nut 27, the joint plate 21 has more of a sleeve shape overall than that of a plate in cross section.

Between the two elements 22 and 23, elastically prestressed by their compression, the joint plate 21 in the receiving chamber 24 and with it the back surface 30 is held in a ground position, although it can swivel relative to this under further compression of the two elements 22 and 23. The swivel ability exists with respect to two axes perpendicular to the lengthwise direction of the screw 26 and also in relation to each other. The turning ability of the joint plate 21 about the axial direction of the screw 26 is blocked to prevent a twisting of the back surface 30 relative to the back support 10. The turn prevention is achieved by the engaging of ribs projecting into the inner space of the receiving chamber 25 and formed on the latter into corresponding recesses at the circumference of the elements 22, 23 and the joint plate 21.

Reference number 28 denotes a lid-shaped cover for the rear side of the receiving chamber 24 and reference number 29 denotes a ring-shaped cover for the circumferential region of the receiving chamber, provided mostly for visual appearance.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

We claim:

1. A back rest for a chair, said back rest comprising:
a back support;
a back surface secured to said back support;
a two-axis joint allowing said back surface to swivel, said two-axis joint comprising:
a joint plate connected to the back surface;
two elements made of an elastic material for supporting the two-axis joint in a ground position; and
a receiving chamber connected to the back support, said receiving chamber accommodating the two elements made of an elastic material;
wherein said joint plate is arranged in the receiving chamber between said two elements made from an elastic material, said joint plate holding the two-axis joint in the ground position and swiveling about the two-axis joint; and
wherein said two elements made from an elastic material are supported against the receiving chamber.

2. The back rest according to claim 1, wherein said two elastic elements are loosely accommodated in the receiving chamber and also have no firm connection to the joint plate.

3. The back rest according to claim 1, wherein at least one of the two elastic elements is ring shaped and the back surface is connected to the joint plate through said ring-shaped elastic element.

4. The back rest according to claim 1, wherein said two elastic elements comprise a compressible foam material.

5. The back rest according to claim 4, wherein said compressible foam material is an open-pore PUR foam material.

6. The back rest according to claim 1, wherein said receiving chamber comprises two parts screwed together, wherein one of the two parts is on the back support, and the back surface is connected to the joint plate through the other of said two parts.

7. The back rest according to claim 6, wherein said other of said two parts is a ring-shaped part.

8. The back rest according to claim 6, further comprising a molded lug for causing said joint plate to penetrate the other of said two parts, and wherein the molded lug has play relative to the other of said two parts in the penetration region and expands in the direction of the back surface.

9. The back rest according to claim 8, further comprising a pressure distribution plate having a relatively larger surface and being unable to rotate with respect to the molded lug, wherein said pressure distribution plate is arranged between the back surface and the molded lug.

10. The back rest according to claim 6, wherein said two elastic elements are compressed together and thereby elastically prestressed when said two parts of the receiving chamber are screwed together.

11. The back rest according to claim 1, wherein said back surface is screwed to the joint plate.

12. The back rest according to claim 1, wherein said back surface is screwed to the joint plate by a single screw.

13. The back rest according to claim 1, wherein said joint plate is secured from twisting in the receiving chamber.

* * * * *